US010436043B2

(12) United States Patent
Trappier

(10) Patent No.: US 10,436,043 B2
(45) Date of Patent: Oct. 8, 2019

(54) ROTATIONALLY SYMMETRICAL PART FOR A TURBINE ENGINE ROTOR, AND RELATED TURBINE ENGINE ROTOR, TURBINE ENGINE MODULE, AND TURBINE ENGINE

(71) Applicant: SAFRAN AIRCRAFT ENGINES, Paris (FR)

(72) Inventor: Nicolas Trappier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 330 days.

(21) Appl. No.: 15/128,095

(22) PCT Filed: Mar. 11, 2015

(86) PCT No.: PCT/FR2015/050601

§ 371 (c)(1),
(2) Date: Sep. 21, 2016

(87) PCT Pub. No.: WO2015/145016

PCT Pub. Date: Oct. 1, 2015

(65) Prior Publication Data

US 2017/0122117 A1 May 4, 2017

(30) Foreign Application Priority Data

Mar. 24, 2014 (FR) ..... 14 52474

(51) Int. Cl.
*F01D 5/30* (2006.01)

(52) U.S. Cl.
CPC ..... *F01D 5/3007* (2013.01); *F05D 2250/72* (2013.01); *F05D 2250/73* (2013.01)

(58) Field of Classification Search
CPC ..... F01D 5/16; F01D 5/3007; F05D 2250/72; F05D 2250/73
See application file for complete search history.

(56) References Cited

U.S. PATENT DOCUMENTS 3,045,968 A * 7/1962 Willis ..... F01D 5/3007 416/216
5,474,421 A * 12/1995 Rossmann ..... F01D 5/26 416/203

(Continued)

FOREIGN PATENT DOCUMENTS

| | | |
|---|---|---|
| JP | 61-025506 U | 2/1986 |
| JP | 04-224202 A | 8/1992 |
| JP | 2009-503330 A | 1/2009 |

OTHER PUBLICATIONS

International Search Report with English Language Translation, dated Jun. 19, 2015, PCT Application No. PCT/FR2015/050601.

(Continued)

*Primary Examiner* — Jason D Shanske
*Assistant Examiner* — Aye S Htay
(74) *Attorney, Agent, or Firm* — Womble Bond Dickinson (US) LLP

(57) ABSTRACT

A rotationally symmetrical part, such as a disk, for a turbine engine rotor. The part has a rotational axis (A) and includes, an annular row of teeth defining grooves therebetween for therein holding fir tree-shaped rotor blade roots. Each tooth includes a first side flank, having at least two projecting portions for holding a blade root and separated from each other by a hollow portion, and a second side flank including at least two projecting portions for holding an adjacent blade root and separated from each other by a hollow portion. Each tooth has, on substantially the entire longitudinal dimension thereof, a lack of symmetry in relation to a substantially radial median longitudinal plane. At least one (Continued)

of the circumferences of the projecting portions of the second flank is located between the circumferences of the projecting portions of the first flank and is radially shifted from the circumferences.

10 Claims, 3 Drawing Sheets

(56) References Cited

U.S. PATENT DOCUMENTS

| | | | | |
|---|---|---|---|---|
| 7,048,507 | B2 * | 5/2006 | Wettstein | F01D 5/20 416/203 |
| 8,100,641 | B2 * | 1/2012 | Bracken | F01D 5/027 415/200 |
| 8,876,472 | B2 * | 11/2014 | Dijoud | F01D 5/141 416/2 |
| 2007/0020102 | A1 | 1/2007 | Beeck et al. | |
| 2009/0257877 | A1 | 10/2009 | Alvanos et al. | |
| 2013/0022469 | A1 | 1/2013 | McCaffrey | |

OTHER PUBLICATIONS

Office Action received for Japanese Patent Application No. 2016-558366, dated Dec. 18, 2018, 9 pages (5 pages of English Translation and 4 pages of Office Action).

* cited by examiner

PRIOR ART

ROTATIONALLY SYMMETRICAL PART FOR A TURBINE ENGINE ROTOR, AND RELATED TURBINE ENGINE ROTOR, TURBINE ENGINE MODULE, AND TURBINE ENGINE

TECHNICAL FIELD

The present invention relates to a rotationally symmetrical part for a turbine engine rotor, and in particular a part comprising on the periphery thereof an annular row of teeth, said teeth defining grooves therebetween for holding rotor blade roots. This type of part is a rotor disc, for example.

PRIOR ART

The prior art comprises documents EP-A2-2 549 061, FR-A-485 943, U.S. Pat. Nos. 4,093,399, 2,920,864, US-A1-2007/020102 and U.S. Pat. No. 5,474,421.

A turbine engine rotor disc comprises on the periphery thereof an annular row of broached grooves in which the rotor blade roots are tightly fitted. Each blade generally comprises a vane connected by a platform to a root. Said root comprises two portions, a radially internal portion known as a bulb and a radially external portion known as a stilt. The bulb of the root is connected by the stilt thereof to the platform of the blade.

The root of a blade may be shaped like a fir tree or dovetail. In the case of a dovetail blade root, the bulb thereof comprises one lobe and, in the case of a fir tree-shaped blade root, the bulb thereof comprises two or three lobes. Each lobe is connected to another lobe or to the stilt of the root by a neck, in other words a portion of smaller cross section or thickness.

This type of disc having broached fasteners can be used in a turbine engine compressor or turbine.

Conventionally, the broached fir tree-shaped fasteners are used for relatively highly loaded turbines, in other words for high-speed turbines or turbines having a large duct cross section, as there are greater stresses due to the stronger centrifugal force.

A number of mechanical criteria must be respected in said fasteners:

- the absolute criteria, in other words the strength of the blades and of the teeth of the disc in the resilient range as well as the resistance to vibratory fatigue, oligocyclic fatigue and creep under all normal flight conditions;
- the relative criteria, which correspond to the breakage hierarchy over the entire rotor. This is because a hierarchisation of the stresses must be respected in the blade and in the disc. If the engine malfunctions, the cross section having the greatest tensile stress is the cross section most conducive to breakage. The housing surrounding the turbine must hold any debris that may emanate from the turbine, which is why the greater the amount of blade debris, the more bulky the housing will be in order to be able to contain said debris. Furthermore, there must be no breakage therein of the tooth of the disc as said breakage could cause a chain reaction leading to the release of a large proportion of the blades. To sum up, with reference to FIG. 3, the cross section having the greatest stress should be located in the vane of the blade 10, the cross sections of the lower 12 and upper 14 necks of the bulb 16 should have stresses that are lower than that of the vane ($\sigma bi<\sigma bs<\sigma bp$ (low vane stress)), and the cross sections of the lower 18 and upper 20 necks of the tooth 22 should have a stress that is comparatively less than that of the blade 10, said cross sections being reduced to the resilient limit of the material of the disc 24 at the temperature of the fastener ($\sigma di,s/\sigma e$ of the disc (resilient limit of the material of the disc)$<\sigma bp/\sigma e$ of the blade (resilient limit of the material of the blade)).

In some turbine engines, the absolute criteria are respected but not the breakage hierarchy, as either the cross section is sufficient in the bulb 16 but not in the tooth 22, or the cross section is sufficient in the tooth 22 but not in the bulb 16.

A solution to this problem would consist in increasing the size of the cross sections in the necks, 12, 14 of the bulbs 16 while increasing the size of the necks in the teeth 22. However, the width or total circumferential dimension of the fastener (tooth+bulb) is directly dictated by the shape of the duct as well as the number of blades 10. Modifying the duct would cause a loss of turbine performance, which would lead to a loss of engine performance.

The present invention offers a simple, effective and economical solution to this problem.

DISCLOSURE OF THE INVENTION

The invention relates to a rotationally symmetrical part, such as a disc, for a turbine engine rotor, having a rotational axis and comprising on the periphery thereof, an annular row of teeth, said teeth defining grooves therebetween for holding fir tree-shaped rotor blade roots. Each tooth comprises a first side flank comprising at least two projecting portions that are intended for holding a blade root and are separated from each other by a hollow portion, and a second side flank comprising at least two projecting portions that are intended for holding an adjacent blade root and are separated from each other by a hollow portion. Said at least two projecting portions of the first flank are located on circumferences centred on the rotational axis of the rotationally symmetrical part, and said at least two projecting portions of the second flank are located on circumferences centred on said rotational axis. Said part is characterised in that each tooth has, over substantially the entire longitudinal dimension thereof, a lack of symmetry in relation to a substantially radial median longitudinal plane. At least one of said circumferences of the projecting portions of the second flank of each tooth is located between the circumferences of the projecting portions of the first flank and is radially shifted from said circumferences.

In the present application, "substantially radial median longitudinal plane" of an element (such as a tooth or a groove) of a rotationally symmetrical part, is understood to be a plane which extends along a longitudinal axis of the element and which passes substantially through the midpoint of said element. Said plane has a substantially radial orientation relative to a longitudinal or rotational axis of the part. The longitudinal axis of the element may be substantially parallel to the longitudinal or rotational axis of the part. In this case, the aforementioned plane extends along the longitudinal axis of the part.

In the prior art, the teeth of a rotationally symmetrical rotor part, such as a disc, each have a symmetry in relation to a substantially radial median longitudinal plane. In contrast, according to the invention, each tooth of the rotor part is not symmetrical relative to a substantially radial median longitudinal plane. This allows the aforementioned problem to be solved by facilitating a better distribution of the concentrations of stresses in the teeth of the part. This allows, for example, for greater widths or circumferential dimensions at the necks of the teeth of the disc. The cross sections of the teeth of the disc can be increased without the cross sections of the bulbs of the blade roots being reduced.

The invention in particular makes it possible to design a turbine that is much more highly loaded than in the prior art. It further allows blades having similar roots (fir tree-shaped) but having dimensional differences to be fitted and held.

Unlike in the prior art where provision is made for blades having stilts of large radial dimension and blades having stilts of smaller radial dimension for the same rotor disc, the stilts in this case may have similar radial dimensions. Providing fastenings at different heights is disadvantageous for the largest stilts as it constitutes additional mass which must therefore be compensated by a larger fastening. This is why it is particularly advantageous to limit the shift in order to achieve greater enlargement of the teeth of the disc, without incurring too great a penalty in the increased weight of the blades having the largest stilts. By arranging the teeth as described in the main claim, the aims of the invention are attained.

Each groove of the part may have, over substantially the entire longitudinal dimension thereof, a symmetry in relation to a substantially radial median longitudinal plane.

In a particular embodiment of the invention, the circumference of at least one of said projecting portions of the second flank substantially passes through a hollow portion of the first flank. The circumferences of two adjacent projecting portions of the second flank of each tooth can substantially pass through two respective hollow portions of the first flank of said tooth.

The grooves may have different depths or radial dimensions.

Preferably, the grooves comprise a first series of identical grooves distributed evenly about the rotational axis of the part, and a second series of identical grooves therebetween, which are different from the grooves of the first series and are evenly distributed about the rotational axis of the part, each groove of the first series being located between two grooves of the second series, and each groove of the second series being located between two grooves of the first series.

The present invention also relates to a turbine engine rotor, comprising an annular part as described above and an annular row of blades which each comprise a vane connected to a fir tree-shaped root which is tightly fitted in a groove of the part, each root comprising a radially external stilt and a radially internal bulb, characterised in that the row of blades comprises a first series of blades having stilts of radial dimension D5 and a second series of blades having stilts of radial dimension D6 which is greater than D5, each blade of the first series being located between two blades of the second series, and each blade of the second series being located between two blades of the first series.

The present invention also relates to a turbine engine module, such as a compressor or a turbine, comprising at least one annular part or at least one rotor as described above.

The present invention relates finally to a turbine engine, comprising at least one annular part or at least one rotor as described above.

DESCRIPTION OF THE FIGURES

The invention will be better understood and other details, features and advantages of the invention will appear more clearly on reading the following description given as a non-limiting example with reference to the accompanying drawings, in which.

DETAILED DESCRIPTION

Figure 1:
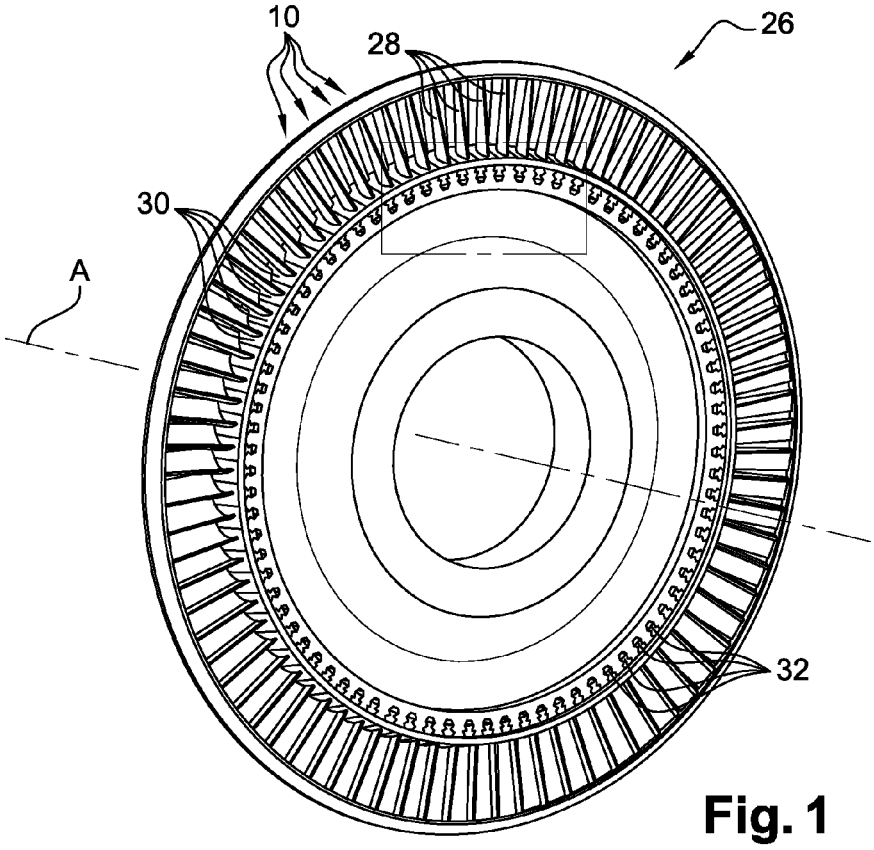
FIG. 1 is a schematic perspective view of a turbine engine rotor, and in particular of a rotor wheel, according to the prior art.
Figure 2:
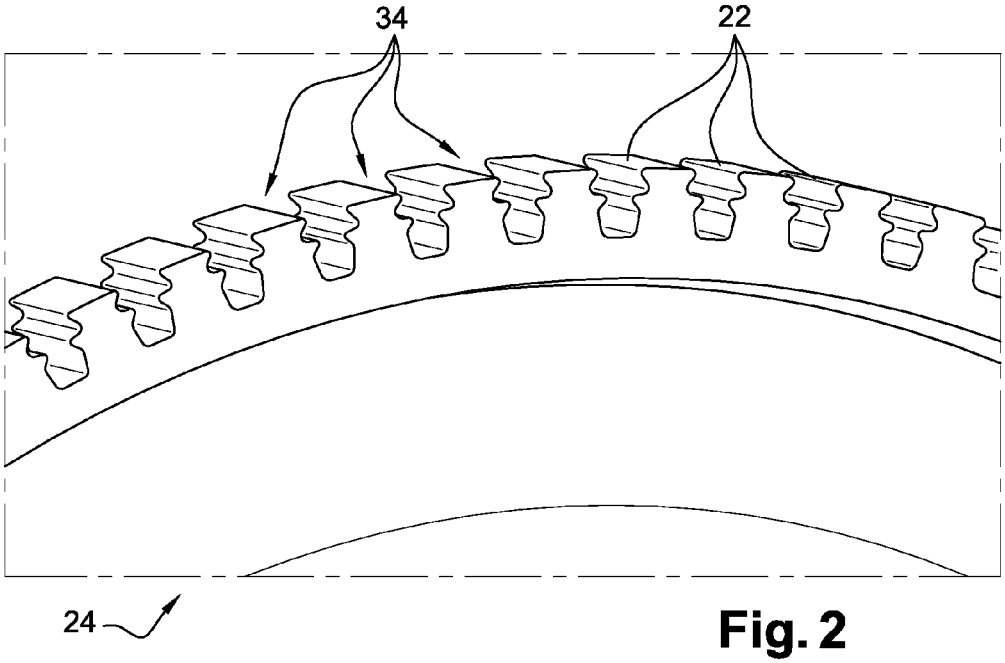
FIG. 2 is a larger-scale partial schematic perspective view of the disc of the rotor wheel of FIG. 1.

Reference is made first to FIGS. 1 and 2 which show a rotor wheel 26 of a turbine engine, said wheel comprising a disc 24 carrying on the periphery thereof an annular row of blades 10.

Each blade 10 comprises a vane 28 connected by a platform 30 to a root 32 which is tightly fitted in a groove 34 on the periphery of the disc 24.

The disc 24 comprises on the periphery thereof an annular row of teeth 22 which define grooves 34 therebetween for receiving the roots 32 of the blades 10. The number of grooves 34 or of teeth 22 of the disc 24 is therefore equal to the number of blades 10 that it can carry.

The grooves 34 are obtained by broaching the outer periphery of the disc 24 and in this case have an orientation substantially parallel to the longitudinal or rotational axis A of the disc 24.

Figure 3:
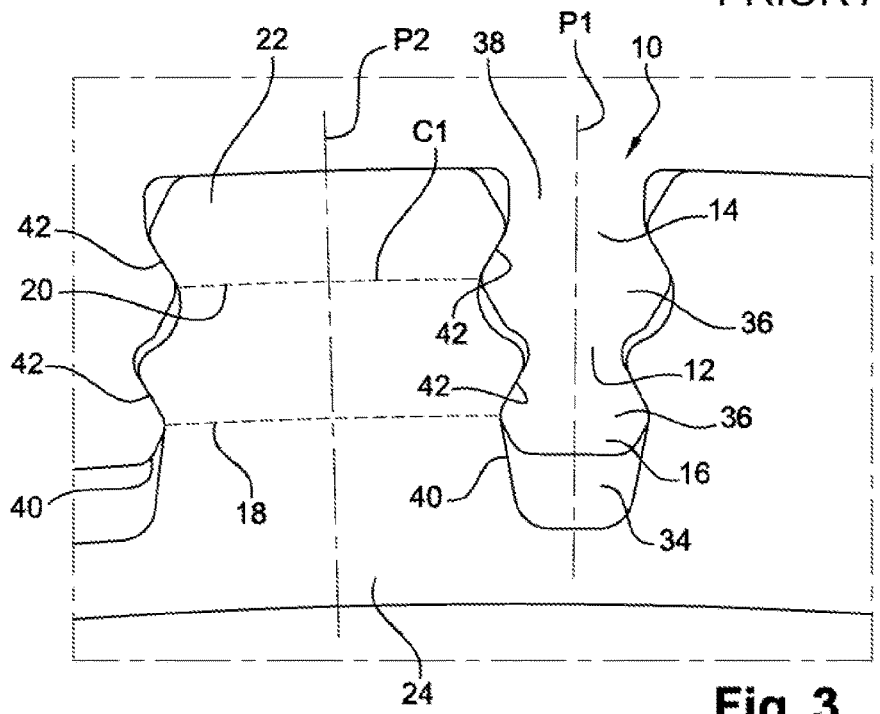
FIG. 3 is a schematic view of teeth of a rotor disc according to the prior art.

As can be seen more clearly in FIG. 3, the blade roots 32 are in this case in the shape of a fir tree, having two lobes 36. A blade root 32 comprises a radially external stilt 38 and a radially internal bulb 16 which is connected by the stilt 38 to the platform of the blade 10.

Each blade root 32 comprises two necks 12, 14 (or portions of lesser thickness or cross section), a lower neck 12 between the two lobes 36 of the bulb 16, and an upper neck 14 between the upper lobe and the stilt 38. Each root 32 has a symmetry in relation to a substantially radial median longitudinal plane P1.

Each tooth 22 of the disc 24 comprises two side flanks 40 which are shaped to cooperate with the roots 32 of adjacent blades 10 and to hold them radially in the grooves 34.

Each flank 40 of a tooth 22 comprises in this case two surfaces 42, respectively an upper and a lower surface. The upper surface 42 forms a support face for a side face of the upper lobe of a blade root, and the lower surface 42 forms a support face for a side face of the lower lobe of said blade root.

The surfaces 42 of a flank 40 are formed by projecting portions which extend over substantially the entire longitudinal dimension of the tooth 22, as can be seen in FIG. 1. The surfaces 42 of a flank 40 are separated from each other by a hollow portion which also extends over substantially the entire longitudinal dimension of the tooth 22.

In the prior art, as can be seen in FIG. 3, each tooth 22 has a symmetry in relation to a substantially radial median longitudinal plane P2. Because of said symmetry, the hollow portions of the flanks 40 of one tooth 22 are located substantially on the same circumference C1 centred on the axis A. Said hollow portions define an upper neck 20 of the tooth 22. The tooth 22 comprises a lower neck 18 between the lower surfaces 42 thereof and the bottoms of the grooves 34.

It will be understood that it is not possible to increase the size of the cross sections in the necks 12, 14 of the bulbs 16 while increasing the size of the necks 18, 20 in the teeth 22. It will also be understood that the widths of the teeth, in the region of the hollow portions thereof (circumference C1), are small, which tends to make the teeth thereof brittle.

Figure 4:
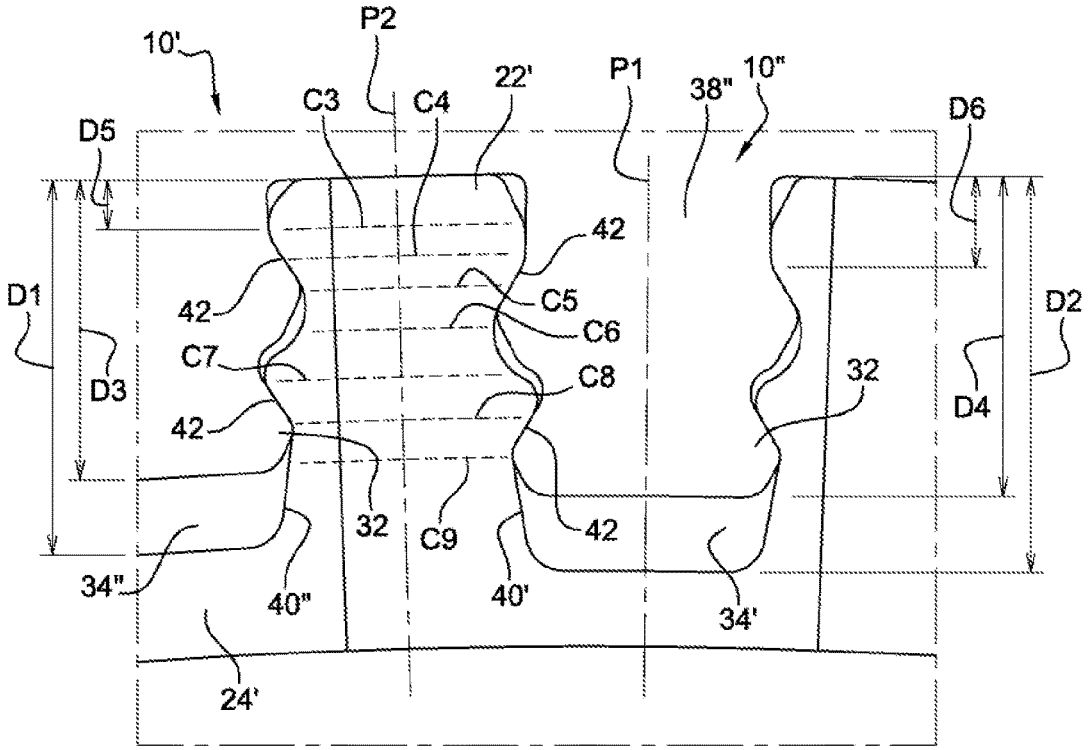
FIG. 4 is a schematic view of teeth of a rotor disc according to the invention.

As can be seen in FIG. 4, the present invention allows this problem to be overcome by the fact that each tooth 22' of the disc 24' has, over substantially the entire longitudinal dimension thereof, a lack of symmetry relative to the substantially radial median longitudinal plane P2.

As described earlier, each tooth 22' comprises two side flanks 40', 40" which are shaped to cooperate with the roots 32 of adjacent blades 10', 10" and to hold said roots radially in the grooves 34', 34".

Each flank 40', 40" of a tooth 22' comprises two surfaces 42, respectively an upper and a lower surface. The upper surface 42 forms a support face for a side face of the upper lobe of a blade root, and the lower surface 42 forms a support face for a side face of the lower lobe of said blade root.

The surfaces 42 of a tooth flank 40', 40" are formed by projecting portions which extend over substantially the entire longitudinal dimension of the tooth, as can be seen in FIG. 1. The surfaces 42 of a flank 40', 40" are separated from each other by a hollow portion which also extends over substantially the entire longitudinal dimension of the tooth. The lower surface 42 of a flank 40', 40" is separated from the bottom of the corresponding groove 34', 34" by another hollow portion which also extends over substantially the entire longitudinal dimension of the tooth.

As can be seen in the drawing, the upper projecting portions of the flanks 40', 40" of one tooth 22' are not located on the same circumference. This is also the case for the projecting lower portions thereof, for the upper hollow portions thereof and for the lower hollow portions thereof. On the contrary, in the example shown, the upper projecting portion of a first flank 40" (in this case the left flank of the tooth 22') is located on a circumference C3 which has a larger diameter than that of the circumference C4 passing through the upper projecting portion of the second flank 40" (the right flank of the tooth 22'). Said circumference C4 has a diameter greater than that of the circumference C5 passing through the upper hollow portion of the first flank 40", which itself has a diameter greater than that of the circumference C6 passing through the upper hollow portion of the second flank 40'. Said circumference C6 has a greater diameter than that of the circumference C7 passing through the lower projecting portion of the first flank 40", which itself has a diameter greater than that of the circumference C8 passing through the lower projecting portion of the second flank 40'. Said circumference C8 substantially passes through the lower hollow portion of the first flank 40", and has a diameter greater than that of the circumference C9 passing through the lower hollow portion of the second flank 40'.

The radial shift between the hollow portions of the flanks of each tooth makes it possible to increase the width of the teeth in the region of said hollow portions and thus to improve the mechanical strength of the teeth.

Furthermore, as can be seen in the drawing, the grooves 34', 34" of the disc 24' are not all identical. The disc 24 comprises grooves 34" having a depth or radial dimension D1, and grooves 34' having a depth or radial dimension D2 which is greater than D1.

The grooves 34' are distributed evenly about the longitudinal axis of the disc 24' and each groove 34' is located between two grooves 34". Similarly, the grooves 34" are distributed evenly about the longitudinal axis of the disc 24' and each groove 34" is located between two grooves 34'.

As in the prior art, each groove 34', 34" of the disc 24' has, over substantially the entire longitudinal dimension thereof, a symmetry relative to the substantially radial median longitudinal plane P1 thereof.

Neither are the blades 10', 10" which form a rotor wheel together with the disc 24' all identical. The wheel comprises blades 10' of which the roots each have a radial dimension D3, and blades 10" of which the roots each have a radial dimension D4 which is greater than D3.

The blades 10' are evenly distributed about the longitudinal axis of the disc 24' and each blade 10' is located between two blades 10". Similarly, the blades 10" are evenly distributed about the longitudinal axis of the disc 24' and each blade 10" is located between two blades 10'.

The bulbs 16' of the blades 10' are substantially identical to those of the blades 10". The roots of the blades 10' therefore differ from the roots of the blades 10" by the stilts 38', 38" thereof, and in particular by the radial dimension of the stilts 38', 38" thereof. The stilts 38' of the blades 10' have a radial dimension D5 that is less than that D6 of the stilts 38" of the blades 10".

The blades 10', 10" are mounted on the disc 24' as in the prior art, by tightly fitting the roots of the blades in the grooves 34', 34" of the disc 22', in such a way that the blades 10" of which the roots have the largest radial dimension D4 are fitted in the grooves 34' having the largest radial dimension D2, and thus such that the blades 10' of which the roots have the smallest radial dimension D3 are fitted in the grooves 34" having the smallest radial dimension D1.

Figure 5:
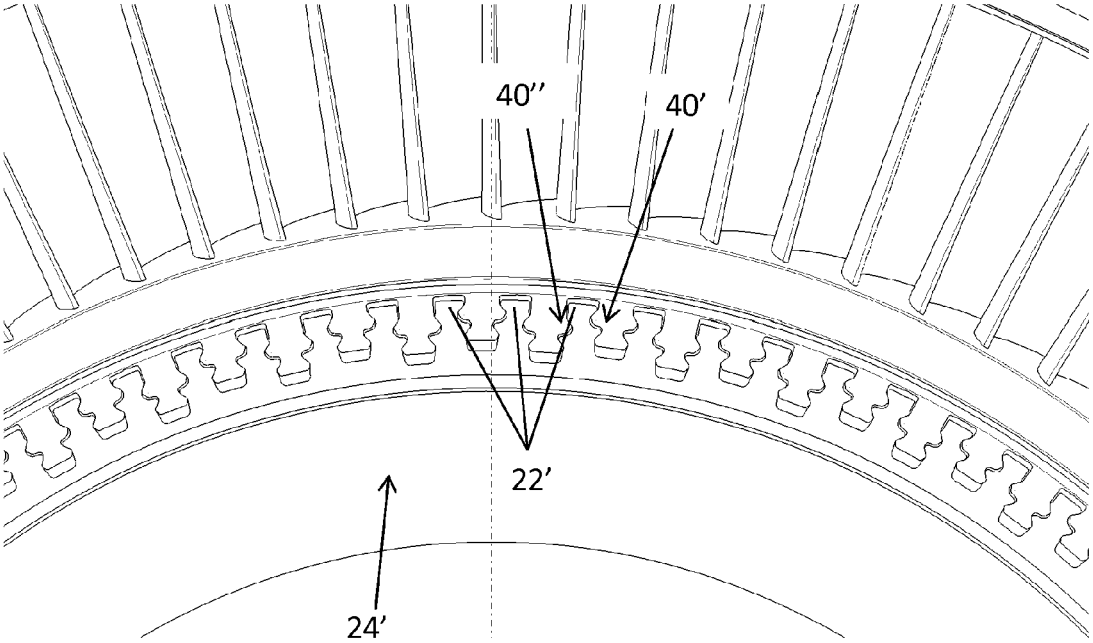
FIG. 5 is a schematic view similar to that of FIG. 4 and showing a variant of the invention.

FIG. 5 shows a variant of the invention which is similar to the embodiment of FIG. 4. The preceding description relating to FIG. 4 applies to FIG. 5, provided it is not contradicted by what follows.

In the example shown, the projecting portions of one of the flanks 40', 40" of each tooth are aligned, substantially in a circumferential direction, with the hollow portions of the other flank of said tooth, and the hollow portions thereof are also aligned, substantially in a circumferential direction, with the projecting portions of the other flank.

The upper projecting portion of the second flank 40' is located on a circumference that passes through the upper hollow portion of the first flank 40". The lower projecting portion of the first flank 40" is located on a circumference that passes through a hollow portion of the second flank 40'. The lower projecting portion of the second flank 40' is located on a circumference that passes through the lower hollow portion of the first flank 40".

This configuration allows each tooth to have a width or circumferential dimension that is relatively constant over the entire radial extent thereof, which is advantageous in terms of the mechanical strength of the teeth.

The invention claimed is:

1. A rotationally symmetrical part, for a turbine engine rotor, having a rotational axis and comprising on the periphery thereof an annular row of teeth which define grooves therebetween for holding fir tree-shaped rotor blade roots, each tooth comprising a first side flank comprising at least two projecting portions that are configured to hold one of the blade roots and are separated from each other by a hollow portion, and a second side flank comprising at least two projecting portions that are configured to hold an adjacent blade root and are separated from each other by a hollow portion, said at least two projecting portions of the first flank being located on circumferences centred on the rotational axis of the rotationally symmetrical part, and said at least two projecting portions of the second flank being located on circumferences centred on said rotational axis, wherein each tooth has, over substantially an entire longitudinal dimension thereof, a lack of symmetry in relation to a substantially radial median longitudinal plane passing through a midpoint of each respective tooth, at least one of said circumferences of the projecting portions of the second flank of each tooth being located between the circumferences of the projecting portions of the first flank and being radially shifted from said circumferences, wherein each groove has, over substantially the entire longitudinal dimension thereof, a symmetry in relation to a substantially radial median longitudinal plane passing through a midpoint of the respective groove.

2. The rotationally symmetrical part according to claim 1, wherein the circumference of at least one of said projecting portions of the second flank of each tooth passes substantially through the respective hollow portion of the first flank of said tooth.

3. The rotationally symmetrical part according to claim 1, wherein the circumferences of two adjacent projecting portions of the second flank of each tooth pass substantially through two respective hollow portions of the first flank of said tooth.

4. The rotationally symmetrical part according to claim 1, wherein the grooves have different depths or radial dimensions.

5. The rotationally symmetrical part according to claim 1, wherein the grooves comprise a first series of identical grooves distributed evenly about the rotational axis of the part, and a second series of identical grooves therebetween, which are different from the grooves of the first series and are evenly distributed about the rotational axis of the part, each groove of the first series being located between two grooves of the second series, and each groove of the second series being located between two grooves of the first series.

6. The turbine engine rotor, comprising the rotationally symmetrical part according to claim 1 and an annular row of blades which each comprise a vane connected to a fir tree-shaped root which is tightly fitted in a groove of the part, each root comprising a radially external stilt and a radially internal bulb, wherein the row of blades comprises a first series of blades having stilts of radial dimension D5 and a second series of blades having stilts of radial dimension D6 which is greater than D5, each blade of the first series being located between two blades of the second series, and each blade of the second series being located between two blades of the first series.

7. A turbine engine module, comprising at least one rotationally symmetrical part according to claim 1.

8. A turbine engine, comprising at least one rotationally symmetrical part according to claim 1.

9. A turbine engine module, comprising at least one rotor according to claim 6.

10. A turbine engine, comprising at least one rotor according to claim 6.

* * * * *